US006252939B1

(12) United States Patent
Young et al.

(10) Patent No.: US 6,252,939 B1
(45) Date of Patent: Jun. 26, 2001

(54) X-RAY EXAMINATION APPARATUS INCLUDING AN X-RAY FILTER

(75) Inventors: Edward W. A. Young; Menno W. J. Prins; Johannes W. Weekamp; Jacobus B. Giesbers; Petrus W. J. Linders, all of Eindhoven; Andreas C. M. Van Nes, Geldrop, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/440,766

(22) Filed: Nov. 16, 1999

(30) Foreign Application Priority Data

Nov. 17, 1998 (EP) ..... 98203898

(51) Int. Cl.[7] ..... G21K 3/00
(52) U.S. Cl. ..... 378/156; 378/158; 378/157
(58) Field of Search ..... 378/156, 157, 378/158, 159, 145

(56) References Cited

U.S. PATENT DOCUMENTS 5,625,665 * 4/1997 Fokkink et al. ..... 378/159
5,666,396 * 9/1997 Linders et al. ..... 378/156
5,751,786 * 5/1998 Welters et al. ..... 378/156
5,966,426 * 10/1999 Marra et al. ..... 378/159
6,118,855 * 9/2000 Welters et al. ..... 378/156

FOREIGN PATENT DOCUMENTS

WO9703449 1/1997 (WO) ..... G21K/3/00

* cited by examiner

*Primary Examiner*—Robert H. Kim
*Assistant Examiner*—Drew A. Dunn
(74) *Attorney, Agent, or Firm*—John F. Vodopia

(57) ABSTRACT

The X-ray examination apparatus includes an X-ray source, an X-ray detector and an X-ray filter which is located between the X-ray source and the X-ray detector. The X-ray filter includes elements, notably capillary tubes, and the X-ray absorptivity of separate filter elements is adjustable by adjustment of a quantity of X-ray absorbing liquid in the respective filter elements. The quantity of X-ray absorbing liquid in the individual filter elements is adjusted by way of electric voltages applied to the individual filter elements. A control system is provided to apply the electric voltages selectively to the individual filter elements. The control system includes voltage lines and switching elements which electrically couple the filter elements to an electric voltage source. The filter elements are formed by spaces between corrugated plates or parallel plates provided with separating members, such as protrusions which extend transversely of the plates. The voltage lines are disposed on the plates. Preferably, the plates are formed from a stack of extendable wall foils and separating foils are provided partially between the wall foils so as to adapt the spacing of the voltage lines to the spacing of the switching elements.

8 Claims, 4 Drawing Sheets

X-RAY EXAMINATION APPARATUS INCLUDING AN X-RAY FILTER

BACKGROUND OF THE INVENTION

1. Field of the Invention

The invention relates to an X-ray examination apparatus which includes an X-ray source, an X-ray detector, an X-ray filter which includes a plurality of filter elements and is arranged between the X-ray source and the X-ray detector, an electric voltage source and a control system for selectively applying electric voltages to individual filter elements, which control system includes voltage lines, and the filter elements being connected to the electric voltage source by way of voltage lines, and the X-ray absorptivity of the individual filter elements being adjustable by adjustment of a quantity of X-ray absorbing liquid in individual filter elements on the basis of the electric voltages applied to the individual filter elements.

2. Description of Related Art

An X-ray examination apparatus of this kind is known from international patent application WO 97/03449.

The X-ray examination apparatus is used to form an X-ray image of an object to be examined, for example a patient to be radiologically examined. The X-ray source irradiates the object by means of an X-ray beam and an X-ray image is formed on the X-ray detector due to local differences in the X-ray absorption within the object. The X-ray filter ensures that the range of brightness values of the X-ray image remains limited. The X-ray filter is adjusted in such a manner that on the one hand parts of the X-ray beam which are only insignificantly attenuated by the object are slightly attenuated by the X-ray filter and that, on the other hand, parts of the X-ray beam which are significantly attenuated by the object are transmitted by the X-ray filter practically without attenuation. Because the brightness values of the X-ray image lie within a limited range, the X-ray image can be very readily processed further in order to achieve a good rendition of even small details of low contrast.

The X-ray filter of the known X-ray examination apparatus is provided with a bundle consisting of a very large number of capillary tubes, each of which communicates with the X-ray absorbing liquid by way of one end. The quantity of X-ray absorbing liquid present in the individual capillary tubes is influenced by the electric voltage applied to the wall of the capillary tubes. It has been found that the adhesion between the wall of the capillary tubes and the X-ray absorbing liquid is dependent on the electric potential difference between the wall of such a capillary tube and the X-ray absorbing liquid.

The voltage lines extend between the capillary tubes in the X-ray filter of the known X-ray examination apparatus. The capillary tubes are connected to one of the voltage lines by way of a respective field effect transistor. The field effect transistors are arranged between the capillary tubes. It is a drawback of the X-ray filter of the known X-ray examination apparatus that a rather large amount of space is required for the voltage lines to extend between the capillary tubes. Consequently, the active surface area of the known X-ray filter is significantly smaller than the overall surface area of the X-ray filter. Moreover, the field effect transistors are arranged in a region which is exposed to X-rays during operation of the X-ray examination apparatus. The X-rays may affect the field effect transistors so that the service life of the known X-ray filter is limited.

Citation of a reference herein, or throughout this specification, is not to construed as an admission that such reference is prior art to the Applicant's invention of the invention subsequently claimed.

SUMMARY OF THE INVENTION

It is an object of the invention to provide an X-ray examination apparatus which includes an X-ray filter which is adjustable on the basis of respective quantities of X-ray absorbing liquid in individual filter elements and has an active surface area which is larger than that of the known X-ray filter.

It is a further object of the invention to provide an X-ray filter whose service life is significantly longer than that of the known X-ray filter.

This object is achieved by means of an X-ray examination apparatus according to the invention which is characterized in that:

the filter elements are formed by spaces between plates which are locally attached to one another, and the voltage lines are provided at least partly on one or more of the plates.

The filter elements have the shape of capillary tubes which are formed by spaces between the plates. Preferably, the plates are provided with separating members. The separating members separate neighboring filter elements from one another between neighboring plates. The separating members are formed, for example by protrusions which are formed transversely of the plates. Alternatively, use can be made of corrugated plates; the corrugations of the plates then constitute the separating members. The individual filter elements are provided with respective electrodes which are arranged on the parallel plates, for example on the side of the parallel plates which faces the inner side of the relevant filter elements. If desired, the electrodes can be covered with an electrically insulating dielectric layer and/or with a hydrophobic coating layer. The electrodes receive the electric voltage whereby the quantity of X-ray absorbing liquid present within the respective filter elements is influenced. The electric voltages are applied to the electrodes via the voltage lines.

Because the voltage lines extend across the plates, between the filter elements hardly any additional space is required for the voltage lines. Consequently, the voltage lines do not take up any active space of the X-ray filter so that the active surface area of the X-ray filter is larger than that in the known X-ray examination apparatus. The active surface area of the X-ray filter is the surface area of the X-ray filter via which the absorption of the X-rays can be controlled.

The voltage lines can be readily continued across the parallel plates so as to reach a region which is not traversed by the X-ray beam during operation of the X-ray examination apparatus. Switching elements can then be positioned in such a region which is not traversed by the X-ray beam and the electrodes can be connected to the switching elements by way of the voltage lines extending across the parallel plates. In that case the switching elements are not exposed to X-rays during operation of the X-ray examination apparatus. Degrading of the switching elements by the X-rays is thus avoided and hence the service life of the X-ray filter is prolonged. The switching elements form part of the control unit and the voltage lines are connected to the electric voltage source via the switching elements. The respective electrodes of the individual filter elements are thus connected to the electric voltage source via the respective voltage lines and the switching elements. The electric voltage is applied to the associated filter element, specifically to the electrode of said filter element, by closing a switching element as desired. Preferably, the switching elements are formed by thin-film transistors which can be switched by applying a gate voltage to a gate contact of such a thin-film transistor. Furthermore, the individual thin-film transistors are connected to the electrodes of the filter elements, for example by way of their respective drain contact, and to the voltage lines by way of their respective source contact. The switching elements may also be constructed as integrated circuits in semiconductor technology, for example silicon.

The corrugated plates are preferably formed by flexible wall foils. In that case the filter elements are preferably formed by locally attaching the wall foils in a stack of wall foils to one another and by subsequently expanding the stack of wall foils essentially transversely of the surface of the wall foils, for example by stretching. Between neighboring, essentially parallel wall foils, spaces are thus formed at the areas where the neighboring wall foils are not attached to one another, which spaces act as filter elements. When the neighboring wall foils are locally attached to one another along narrow, continuous bonding seams, the spaces are formed as capillary tubes. The dimensions of the tubes, notably the cross-section thereof, are determined by the spacing and the width of the bonding seams and by the degree of expansion of the stack of wall foils.

Like the electrodes, the voltage lines are preferably provided on the wall foils already before the wall foils are stacked and the stack is expanded. This makes it possible to provide the voltage lines and the electrodes on the wall foils as metallization patterns while the wall foils are still loose from one another and still have a flat shape. In such circumstances the metallization patterns can be provided in a simple and uncomplicated manner. For example, the metallization patterns can be simply formed by means of a laser ablation process. It is notably not necessary to guide the voltage lines between the filter elements after the filter elements have already been formed. Instead, the voltage lines are provided already before the formation of the filter elements and, when the filter elements are formed by the stretching of the stack of wall foils, the voltage lines on the wall foils are distorted together with the wall foils so that the voltage lines will automatically extend between the spaces between the wall foils constituting the filter elements.

Preferably, in parts of the stack of foils a number of intermediate foils is inserted between the wall foils. The intermediate foils are preferably provided between the filter elements and the region where the voltage lines emerge from the stack of foils. The intermediate foils preferably extend into the region where the voltage lines emerge for the foil stack. The intermediate foils may continue until the angle of the foil stack. The intermediate foils changes the distance between voltage lines on separate wall foils. The intermediate foils are provided notably at the edge of the stack of wall foils in order to ensure that in the region where the voltage lines emerge from the stack of foils the distance between the voltage lines on separate wall foils differs from the distance between the voltage lines on neighboring foils which are not separated by intermediate foils. Depending on the size of the filter elements, i.e. the spaces between the wall foils and the thickness and number of intermediate foils the distance between separate wall foils in the region where the voltage lines emerge from the stack of foils is larger or smaller than the distance between wall foils where they are not separated by the intermediate foils and form the filter elements. Because the intermediate foils increase the distances between the voltage lines on separate wall foils in the region where the voltage lines emerge from the stack of wall foils, the voltage lines can be readily connected to an electronic control circuit outside the X-ray filter; this electronic control circuit includes inter alia the switching elements whereby the electric voltages are selectively applied to the electrodes of the filter elements. When the intermediate foils are provided only in the region where the voltage lines emerge from the stack of wall foils, but not in the region in the stack of wall foils where the filter elements are formed as capillary tubes between the wall foils, the distance between neighboring wall foils where they form the filter elements is much smaller than the distance between the wall foils in the region where the voltage lines emerge from the stack of wall foils. Thus, an X-ray filter can be realized which includes a large number of small capillary tubes which are also arranged very close to one another and in which the voltage lines can also be simply connected to the electronic control circuit which is arranged outside the X-ray filter. Advantageously, the distances between the voltage lines on separate wall foils can be accurately adapted to the distances between connection contacts of the electronic control circuit outside the X-ray filter. Furthermore, the voltage lines on one and the same wall foil preferably fan out slightly in the region where the voltage lines emerge from the stack of foils. It is thus achieved that the distance between the foils in the plane of the relevant wall foil accurately corresponds to the connection contacts of the electronic control circuit with the switching elements.

The intermediate foils are preferably made of the same material as the wall foils, but neither voltage lines nor electrodes are provided thereon. Because the same foil material is used for the intermediate foils and the wall foils, the intermediate foils are bonded to one another and to the wall foils in the same circumstances as those in which the wall foils are locally bonded to one another. This avoids the necessity of a complex process in which, for example the circumstances such as temperature and pressure must be frequently varied in order to treat the stack of wall foils with the locally inserted intermediate foils. The wall foils are notably locally bonded to one another and the intermediate foils are bonded to one another and to the wall foils in the same circumstances. Preferably, the stack of wall foils with the inserted intermediate foils is bonded in a single process step, for example by heating the assembly under pressure. Preferably, structured separating layers are provided between the wall foils. Openings are recessed in said structured separating layers so that neighboring wall foils can contact one another at the area of the openings in the separating layer when a pressure is exerted on the stack of foils. When the stack of foils is heated under pressure, the neighboring wall foils are locally fused at the areas where they contact one another via the openings in the separating layers. The wall foils remain separated at the areas where they are kept apart by the material of the separating layers. The bonded stack of wall foils with the intermediate foils is subsequently stretched in the direction transversely of the foils so that the capillary tubes are formed between the wall foils. Preferably, the separating layers are formed as a number of preferably mutually parallel metal tracks. The metal tracks also act as the electrodes via which the electric voltages are applied to the individual capillary tubes in order to control the quantity of X-ray absorbing liquid in the capillary tubes.

Preferably, the voltage lines extend across the foils approximately transversely of or even perpendicularly to the longitudinal axis of the capillary tubes. The voltage lines thus follow the shortest path from the individual capillary tubes in the stack of wall foils and from the region which is exposed to X-rays during operation of the X-ray examination apparatus. Via the shortest possible voltage lines, the capillary tubes are electrically connected to the switching elements and, when the X-ray examination apparatus is in operation, the capillary tubes are situated in the X-ray beam but the switching elements remain outside the X-ray beam. The voltage lines in a further embodiment extend partly transversely of the capillary tubes until they are out of reach of the X-ray beam and outside the reach of the X-ray beam they extend, more or less parallel to or at an angle relative to the longitudinal axis of the capillary tubes, to a region adjacent the X-ray beam and above the stack of wall foils. The electronic control circuit with the switching elements can be arranged in said region adjacent the X-ray beam and above the stack of wall foils without risk of exposure to X-rays.

Preferably, the stack of wall foils is mechanically reinforced at least at one of the edges extending transversely of the surface of the wall foils. This facilitates the connection of the voltage lines, emerging from the stack of foils at the mechanically reinforced edge, to the electronic control circuit with the switching elements. The mechanical reinforcement ensures that the voltage lines accurately remain at the correct distance from one another upon emerging from the stack of wall foils in order to be connected to the connection contacts of the electronic control circuit. The correct distance between the voltage lines upon leaving the stack of wall foils is exactly equal to the corresponding distance between the connection terminals. Preferably, those edges of the wall foils are reinforced which extend essentially parallel to the longitudinal axis of the capillary tubes.

Electrically conductive supply lines are provided on the intermediate foils in an embodiment of the X-ray filter of the X-ray examination apparatus according to the invention. The supply lines are electrically connected to the voltage lines on the wall foils. The electric voltages are applied to the individual filter elements via the supply lines and the voltage lines under the control of the switching elements. Preferably, a plurality of groups of intermediate foils with supply lines are provided and the voltage lines are connected to supply lines of the group of intermediate foils situated nearest to the relevant filter elements. The required length of the voltage lines becomes shorter, because a part of the electrical path from the individual filter elements to the outside of the stack of wall foils extends via the supply lines. For a suitable electrical contact the voltage lines are provided with voltage contact pads and the supply lines are provided with supply contact pads. The voltage contact pads are provided at an end of the voltage lines where the voltage lines reach the intermediate foils across the wall foils. The supply contact pads are provided at an end of the supply lines where the supply lines reach, across the intermediate foils, the ends of the voltage lines on the wall foils. As a result of the use of separate supply lines and voltage lines on the intermediate foils and the wall foils, respectively, the supply lines and the voltage lines can be made to extend in different directions. This enables random selection of the location where the supply lines emerge from the stack of wall foils in the region which is not exposed to X-rays during operation of the X-ray examination apparatus. It has been found that suitably electrically conductive connections are readily realized between the supply lines and the voltage lines by connecting the supply contact pads and the voltage contact pads to one another by way of a clamping contact.

For example, the intermediate foils with the supply lines are inserted into the stack of wall foils in such a direction that during insertion the supply lines are essentially parallel to the voltage lines on the wall foils. Hence, the supply lines are easily brought into correspondence with the voltage lines.

Furthermore, one supply line may be connected to several voltage lines so that various filter elements are activated together. Several supply lines may be connected to a signal voltage so that a lower electrical resistance is achieved between the voltage lines and a control circuit (e.g. a driver IC) which controls the selection of voltage lines to be energized.

BRIEF DESCRIPTION OF THE DRAWING

These and other aspects of the invention are apparent from and will be elucidated, by way of non-limitative example, with reference to the embodiment(s) described hereinafter and the accompanying drawing; therein.

DETAILED DESCRIPTION OF THE PREFERRED EMBODIMENT

Figure 1:
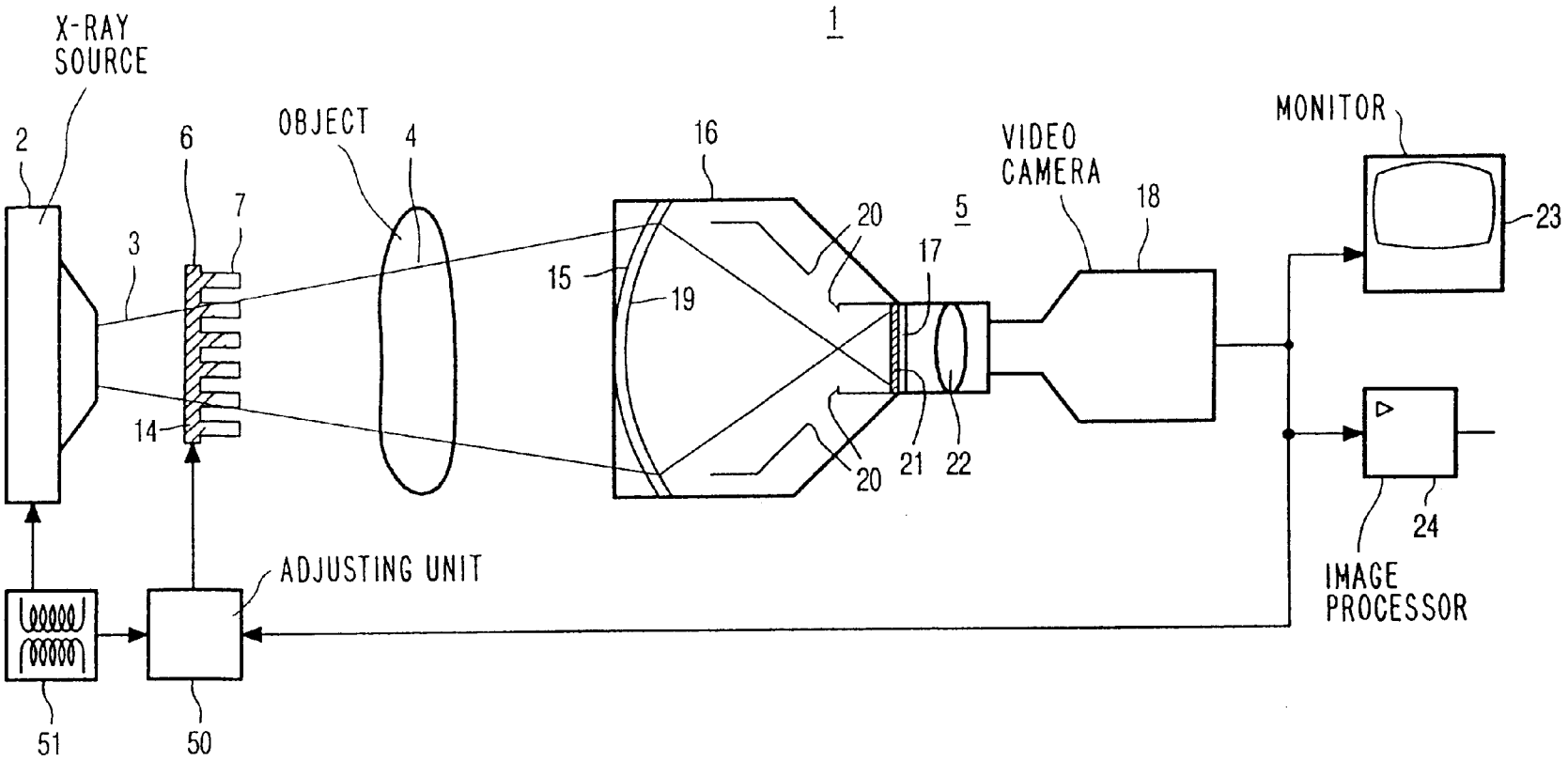
FIG. 1 is a diagrammatic representation of an X-ray examination apparatus 1 according to the invention.

FIG. 1 shows diagrammatically an X-ray examination apparatus 1 according to the invention. The X-ray source 2 emits an X-ray beam 3 for irradiating an object 4. Due to differences in X-ray absorption within the object 4, for example a patient to be radiologically examined, an X-ray image is formed on an X-ray sensitive surface 15 of the X-ray detector 5 which is arranged opposite the X-ray source. A high-voltage power supply 51 supplies the X-ray source 2 with an electric high voltage. The X-ray detector 5 of the present embodiment is formed by an image intensifier/pick-up chain which includes an X-ray image intensifier 16 for converting the X-ray image into an optical image on an exit window 17 and a video camera 18 for picking up the optical image. The entrance screen 19 acts as the X-ray sensitive surface of the X-ray image intensifier which converts incident X-rays into an electron beam which is imaged on the exit window by means of an electron optical system 20. The incident electrons generate the optical image on a phosphor layer 21 of the exit window 17. The video camera 18 is coupled to the X-ray image intensifier 16 by way of an optical coupling 22, for example a lens system or a fiber-optical coupling. The video camera 18 extracts an electronic image signal from the optical image; this image signal is applied to a monitor 23 in order to visualize the image information in the X-ray image. The electronic image signal may also be applied to an image processing unit 24 for further processing.

Between the X-ray source 2 and the object 4 there is arranged the X-ray filter 6 for local attenuation of the X-ray beam. The X-ray absorptivity of individual filter elements 7 of the X-ray filter is adjusted by means of an adjusting unit 50. The X-ray absorptivity of the individual filter elements is controlled by adjustment of the quantity of X-ray absorbing liquid 14 present in the individual filter elements. The quantity of X-ray absorbing liquid 14 in such a filter element is adjusted on the basis of the electric voltage applied to the relevant filter element. The adjusting unit 50 is coupled to the high voltage supply 51 so that the X-ray filter 6 can be adjusted on the basis of the intensity of the X-ray beam 3 emitted by the X-ray source. The adjusting unit 51 is also connected to the video camera. Consequently, the X-ray filter can be adjusted on the basis of the electronic image signal, so on the basis of image information in the X-ray image.

Figure 2:
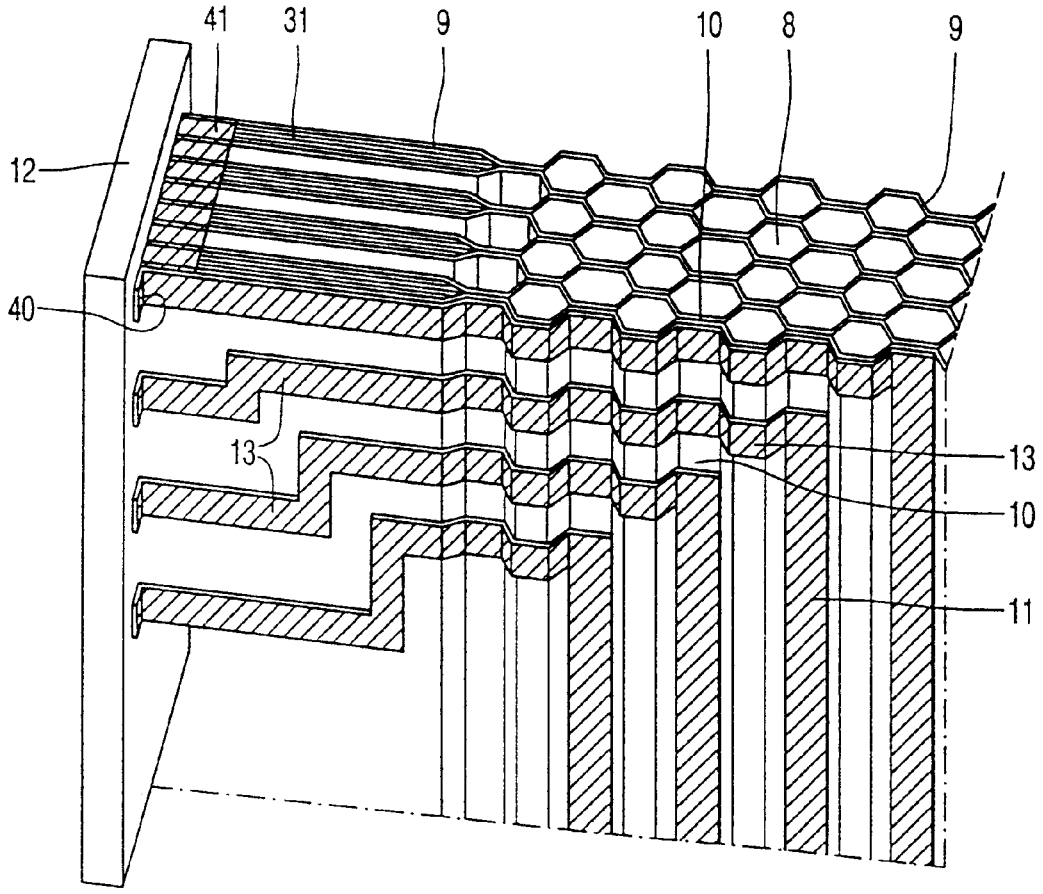
FIGS. 2, 3 and 4 are diagrammatic perspective views of different embodiments of the X-ray filter of the X-ray examination apparatus according to the invention.

FIG. 2 is a diagrammatic perspective view of a first embodiment of the X-ray filter of the X-ray examination apparatus according to the invention. The filter elements 8 in the embodiment shown in FIG. 2 are constructed as capillary tubes. The capillary tubes 8 are formed as spaces between the wall foils 9 which are locally attached to one another along bonding seams 10. The wall foils 9 are preferably plastic foils, polyester foils or polyethylene terephthalate foils (PETP foils). PETP foils of this kind can be readily fused locally by thermal compression, so that the bonding seams are simply formed by narrow strips along which the neighboring PETP foils are fused. It has also been found that bonding seams of this kind are so strong that the PETP foils are not torn loose when the stack of PETP foils is stretched. Each of the capillary tubes 8 is provided with an electrically conductive electrode 11, for example in the form of an aluminium track across the wall of the relevant capillary tube 8. Furthermore, the X-ray filter includes an electronic control unit 12 for controlling the electric voltages applied to the individual capillary tubes 8. To this end, the electronic control unit 12 includes an electronic switching system with thin-film transistors. The electrodes 11 of the capillary tubes 8 are connected to the electronic control unit 12 by way of the voltage lines 13. The voltage lines 13 are electrically conductive tracks, for example aluminium tracks, deposited on the surface of the wall foils 9. The voltage lines 13 spatially separate the electronic switching system from the capillary tubes 8. The electronic control unit 12 is arranged at such a distance from the capillary tubes 8 that the X-ray beam 3 does not pass through the control unit 12 during operation of the X-ray examination apparatus. Because the voltage lines 13 extend across the wall foils 9, they occupy hardly any additional space between the capillary tubes 8.

Furthermore, the wall foils 9 are partly separated from one another by intermediate foils 31. The intermediate foils 31 are arranged between the wall foils 9 in the part between the control unit 12 and the part of the wall foils 9 where the capillary tubes 8 are formed. A plurality of intermediate foils are provided between neighboring wall foils 9, so that in the direction transversely of the longitudinal axis of the capillary tubes 8 the distances between the voltage lines 13 on the relevant separate wall foils 9 are in this example substantially larger than the distances between neighboring capillary tubes 8. Furthermore, voltage lines 13 on one and the same wall foil 9 fan out relative to one another in the region where the relevant wall foil 9 is separated from the neighboring wall foils 9 by intermediate foils 31. Because of the fanning out of the voltage lines 13, in the direction parallel to the capillary tubes 8 the distance between the voltage lines on the same wall foil becomes larger at the area where they emerge from the stack of wall foils 9 than the distance between the voltage lines 13 at the area of the capillary tubes. As a result of the intermediate foils 31 and the fanning out, the distances between the voltage lines 13 at the area where they leave the stack become exactly equal to the distances between contact points 40 on the electronic control unit 12. The voltage lines 13 can thus be readily connected to the contact points 40 of the electronic control unit 12. The electronic control unit 12 forms part of the adjusting unit 50. The stack of wall foils 9 with the intermediate foils 31 is provided with a mechanical reinforcement 41 at the area of the control unit 12. For example, the reinforcement 41 is formed by cured epoxy resin which is provided between the foils.

Figure 3:
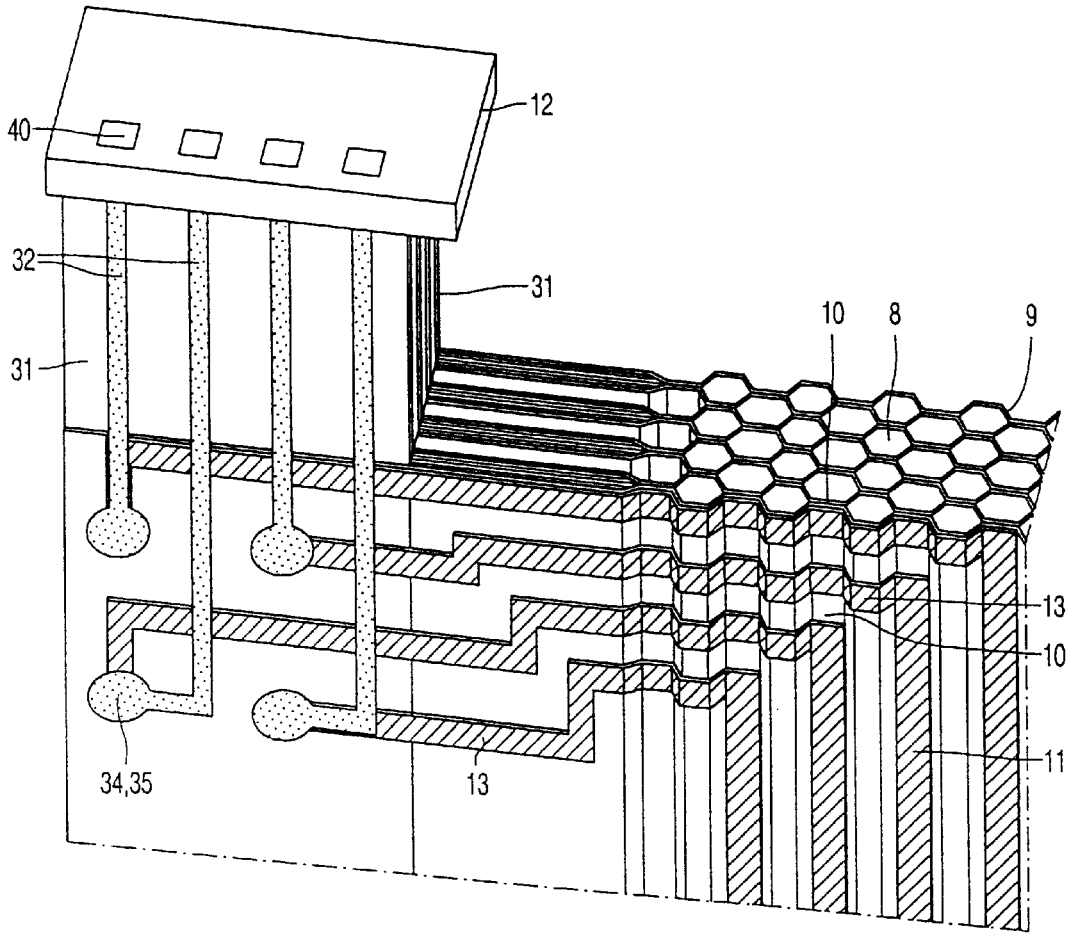

FIG. 3 shows a second embodiment of an X-ray filter of the X-ray examination apparatus according to the invention.

In the X-ray filter shown in FIG. 3 intermediate foils 31 are inserted between the wall foils 9. The intermediate foils 31 are provided in a part of the stack of wall foils 9 in which no capillary tubes are formed. Furthermore, in the direction parallel to the longitudinal axis of the capillary tubes several or even all intermediate foils 31 extend as far as the outside of the stack of wall foils 9. Like in the embodiment shown in FIG. 2, voltage lines 13 extend across the wall foils to the electrodes 11 of the capillary tubes 8. In the embodiment of FIG. 3, furthermore, supply lines 32 are provided on the intermediate foils. The supply lines are electrically conductive, like the voltage lines 13; for example, the supply lines are formed as aluminium tracks. Respective supply lines 32 are connected to respective voltage lines 13 by way of supply contact pads 34 of the supply lines 32 and voltage contact pads 35 of the voltage lines 13. An individual supply line is provided with a supply contact pad 34 at an end where the supply line 32 reaches the relevant individual voltage line 13. Furthermore, an individual voltage line is provided with a voltage contact pad 35 at an end which is remote from the capillary tube 8 whereto the relevant voltage line 13 is connected. A supply contact pad 34 and a voltage contact pad 35 each time form a respective electrical connection between the relevant supply line 32 and the relevant voltage line 13. For example, each of the individual capillary tubes 8 is connected to a single voltage line 13 by way of its electrode 11, and each one of the voltage lines 13 is connected to a respective one of the supply lines 33. The individual capillary tubes 8 in another embodiment are individually provided with two electrodes 11 and per capillary tube the two electrodes 11 are connected to two individual voltage lines 33. Preferably, in that case the two voltage lines are provided on oppositely situated wall foils. Furthermore, the pair of voltage lines 13 for individual capillary tubes 8 is connected to a single supply line 32. Thus, two voltage lines and one supply line are used for each capillary tube 8.

The electrical contact is established notably by pressing or clamping the respective supply contact pads 34 and voltage contact pads 35 mechanically onto one another. It is notably easy to press or clamp the voltage contact pads 35 and supply contact pads 34 together by pressing or clamping the stack of wall foils with the inserted intermediate foils 31 at the area where the intermediate foils 31 are provided. It is notably possible to press a large number of supply contact pads 34 and voltage contact pads together in pairs; each such pair then consists of a supply contact pad and a voltage contact pad of the relevant supply line and voltage line to be connected to one another. The supply and voltage contact pads 35 are preferably constructed as electrically conductive pads at the end of the relevant supply or voltage line. Such a supply or voltage contact pad then actually consists of a widened portion of the relevant supply or voltage line.

It is notably possible to press a large number of supply contact pads 34 and voltage contact pads 35 together in pairs; each such pair then consists of a supply contact pad 34 and a voltage contact pad 35 of the relevant supply and voltage line 13 which are to be connected to one another. It is thus readily possible to establish more than 16,000 connections which are necessary when the X-ray filter according to the invention comprises 128×128 capillary tubes 8, all of which have to be connected to the control unit 12. The supply contact pads 34 and voltage contact pads 35 are preferably constructed as an electrically conductive pad at the end of the relevant supply or voltage line 13. The supply and voltage lines have a width of, for example from 10 μm or 50 μm to 150 μm. The width of the supply and voltage contact pads then amounts to, for example from one and a half to two times the width of the supply and voltage lines. Such a supply or voltage contact pad then actually constitutes a widened portion of the relevant supply or voltage line at the relevant end of such a supply voltage line. The stack of intermediate foils 31 in the embodiment shown in FIG. 3 projects from the stack of wall foils 9. The control unit 12 is arranged at the end of the stack of intermediate foils 31 which is outside the stack of wall foils. Between the intermediate foils 31, supporting the supply lines 32, if desired, additional foils may be provided in order to adapt the distances between the supply lines 32 in the direction transversely of the plane of the intermediate foils 31. Furthermore, in order to adapt the distances between the supply lines 32 in the plane of the relevant intermediate foils 31, the supply lines 32 on the intermediate foils 31 may fan out in the region where the supply lines 32 emerge from the stack of intermediate foils 31. At the area where they emerge from the stack of intermediate foils 31 the spacing of the supply lines 32 can thus be accurately adapted to the spacing of the contact points 40 of the control unit 12.

Figure 4:
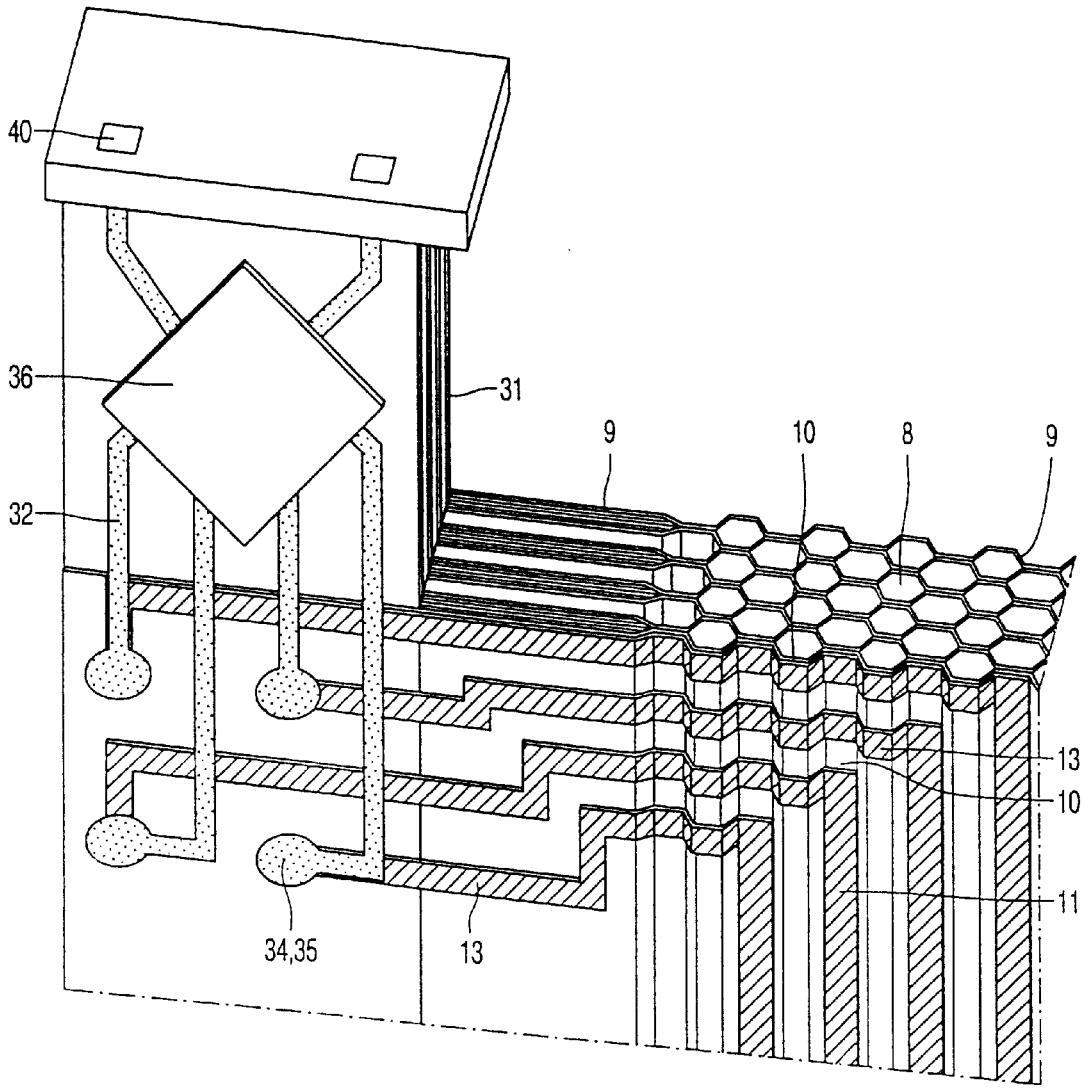

FIG. 4 shows a further embodiment of an X-ray filter of an X-ray examination apparatus according to the invention. In the embodiment shown in FIG. 3 an integrated control circuit 36 (driver IC) is provided on the intermediate foils 31. This control circuit provides the selection of the voltage lines which are to receive electric voltages and the voltage lines which are not to receive electric voltages. The integrated control circuit has a multiple output whereto the supply lines are connected. The input of the integrated control circuit is connected, for example to the video camera 18 or to the high-voltage supply 51 in order to adjust the X-ray filter on the basis of the electronic image signal or the intensity of the X-ray beam, respectively.

All references cited herein, as well as the priority document European Patent Application 98203898.6 filed Nov. 17, 1998, are incorporated herein by reference in their entirety and for all purposes to the same extent as if each individual publication or patent or patent application was specifically and individually indicated to be incorporated by reference in its entirety for all purposes.

What is claimed is:

1. An X-ray examination apparatus comprising:

an X-ray source, an X-ray detector, an X-ray filter which includes a plurality of filter elements and is arranged between the X-ray source and the X-ray detector, an electric voltage source, and a control system including voltage lines for selectively applying electric voltages to individual filter elements, wherein the filter elements are connected to the electric voltage source by way of voltage lines, and the X-ray absorptivity of the individual filter elements is adjustable by adjustment of a quantity of X-ray absorbing liquid in individual filter elements on the basis of the electric voltages applied to the individual filter elements, and wherein the filter elements are formed by spaces between plates which are locally attached to one another, and the voltage lines are provided at least partly on one or more of the plates.

2. An X-ray examination apparatus as claimed in claim 1 wherein the plates are formed by at least partly distorted wall foils.

3. An X-ray examination apparatus as claimed in claim 2 wherein the wall foils are at least partly separated from one another by intermediate foils inserted between the wall foils.

4. An X-ray examination apparatus as claimed in claim 3 wherein the wall foils are provided in the form of a stack of wall foils, local spaces forming the filter elements being present between neighboring wall foils, and wherein the intermediate foils are provided in a part of the X-ray filter which is situated between the filter elements and a region where the voltage lines emerge from the stack of foils.

5. An X-ray examination apparatus as claimed in claim 1 wherein the filter elements are formed as capillary tubes, and wherein the voltage lines extend across the plates essentially transversely of the longitudinal axis of the capillary tubes.

6. An X-ray examination apparatus as claimed in claim 2 wherein the filter elements are formed as capillary tubes, and wherein an edge of one or more wall foils is mechanically reinforced.

7. An X-ray examination apparatus as claimed in claim 3 further comprising supply lines which are provided on one or more intermediate foils, and wherein one or more individual supply lines are electrically connected to one or more individual voltage lines on the wall foils.

8. An X-ray examination apparatus as claimed in claim 7 wherein the supply lines are provided with supply contact pads, wherein the voltage lines are provided with voltage contact pads, and wherein the supply contact pads and the voltage contact pads are connected to one another by way of a clamping contact.

* * * * *